US010260489B2

(12) United States Patent
Chalifoux et al.

(10) Patent No.: US 10,260,489 B2
(45) Date of Patent: Apr. 16, 2019

(54) METHOD OF SUPPLYING FLUID TO A SUBMERSIBLE PUMP

(71) Applicant: Petrospec Engineering Inc., Sherwood Park (CA)

(72) Inventors: Gerald Chalifoux, Sherwood Park (CA); Clint Jones, Sherwood Park (CA)

(73) Assignee: Petrospec Engineering Inc., Sherwood Park (CA)

( * ) Notice: Subject to any disclaimer, the term of this patent is extended or adjusted under 35 U.S.C. 154(b) by 655 days.

(21) Appl. No.: 14/712,806

(22) Filed: May 14, 2015

(65) Prior Publication Data

US 2016/0333869 A1 Nov. 17, 2016

(51) Int. Cl.

| | |
|---|---|
| ***F04B 47/06*** | (2006.01) |
| ***E21B 43/12*** | (2006.01) |
| ***F04B 17/03*** | (2006.01) |
| ***F04B 19/22*** | (2006.01) |
| ***F04D 13/06*** | (2006.01) |

(52) U.S. Cl.

CPC ..... *F04B 17/03* (2013.01); *E21B 43/128* (2013.01); *F04B 19/22* (2013.01); *F04B 47/06* (2013.01); *F04D 13/062* (2013.01)

(58) Field of Classification Search

CPC ..... F04B 17/046; F04B 17/048; F04B 47/06; F04D 13/062; E21B 43/128

USPC ..... 417/414, 423.3

See application file for complete search history.

(56) References Cited

U.S. PATENT DOCUMENTS

| | | | | |
|---|---|---|---|---|
| 2,740,059 A * | 3/1956 | Conery | H02K 5/132 174/21 R |
| 2,938,131 A * | 5/1960 | Maynard | H02K 9/197 310/87 |
| 4,262,226 A * | 4/1981 | Erickson | H02K 5/132 310/87 |
| 4,541,782 A | 9/1985 | Mohn | |
| 5,375,656 A * | 12/1994 | Wilson | E21B 43/128 166/67 |
| 6,017,198 A * | 1/2000 | Traylor | E21B 17/028 166/105 |

(Continued)

FOREIGN PATENT DOCUMENTS

| | | |
|---|---|---|
| CA | 1193913 | 9/1985 |
| CA | 1205006 | 5/1986 |

(Continued)

*Primary Examiner* — Devon C Kramer
*Assistant Examiner* — Christopher S Bobish
(74) *Attorney, Agent, or Firm* — Christensen O'Connor Johnson Kindness, PLLC

(57) ABSTRACT

A fluid delivery system for an inverted electric submersible pump (ESP), where the ESP has a motor section positioned above a pump section in a production path of a hydrocarbon well. The system has a supply of fluid connected to the motor section of the ESP by a supply line and a positive displacement pump that pumps fluid through the supply line to the ESP. A valve is connected between the positive displacement pump and the ESP. The valve is in an open state when the positive displacement pump is pumping fluid. A bypass line is connected in parallel to the positive displacement pump and connected between the normally closed valve and the supply of fluid, the bypass line having a check valve that permits the flow of fluid from the supply of fluid to the ESP.

10 Claims, 4 Drawing Sheets

(56) References Cited

U.S. PATENT DOCUMENTS

| | | | | |
|---|---|---|---|---|
| 6,422,822 | B1 * | 7/2002 | Holmes | F04D 13/083 417/13 |
| 6,554,586 | B1 | 4/2003 | Lustwerk | |
| 7,059,345 | B2 | 6/2006 | Shaw | |
| 8,322,444 | B2 * | 12/2012 | De Camargo | F04B 47/06 166/105 |
| 8,915,303 | B2 * | 12/2014 | Chalifoux | E21B 33/068 166/377 |
| 9,297,377 | B2 * | 3/2016 | Veland | F04B 53/164 |
| 9,303,654 | B2 * | 4/2016 | Felix | F04D 29/128 |
| 9,689,529 | B2 * | 6/2017 | Meyer | F16N 29/02 |
| 2012/0282120 | A1 * | 11/2012 | Krahn | F04D 13/10 417/410.1 |
| 2013/0164152 | A1 * | 6/2013 | Kjonigsen | F04B 47/06 417/279 |

FOREIGN PATENT DOCUMENTS

| | | |
|---|---|---|
| CA | 2618373 | 7/2008 |
| CA | 2769943 | 11/2012 |
| CN | 101030744 | 9/2007 |
| CN | 202483821 | 10/2012 |
| CN | 202810754 | 3/2013 |

* cited by examiner

METHOD OF SUPPLYING FLUID TO A SUBMERSIBLE PUMP

FIELD

This relates to a method of supplying fluid to an electric submersible pump in a well, such as an inverted electric submersible pump.

BACKGROUND

Electric submersible pumps (ESPs) use oil for lubrication and cooling purposes. The ESP motor and seal/protector sections are typically filled with this oil, but may also be supplied from an oil reservoir on surface using capillary tubing. An example of this can be seen in U.S. Pat. No. 5,375,656 (Wilson) entitled "Low Flow Rate Oil Supply System for an Electric Submersible Pump."

SUMMARY

While oil delivery systems are known for electric submersible pumps, difficulties arise for inverted electric submersible pumps as the motor section is subjected to a wider range of pressures, and it can be difficult to accommodate for these wide ranges of pressure while maintaining a constant flow of oil and a sufficient pressure above the downhole pressure.

According to an aspect, there is provided a fluid delivery system for an inverted electric submersible pump. The electric submersible pump comprises a motor section positioned above a pump section in a production path of a hydrocarbon well. The system comprises a supply of fluid connected to the motor section of the electric submersible pump by a supply line. A positive displacement pump pumps fluid through the supply line from the supply of fluid to the electric submersible pump. A valve is connected between the positive displacement pump and the electric submersible pump. The valve is in an open state when the positive displacement pump is pumping fluid and the valve being closable when the positive displacement pump is off. A bypass line is connected in parallel to the positive displacement pump and connected between the normally closed valve and the supply of fluid. The bypass line has a bypass check valve that permits the flow of fluid from the supply of fluid to the electric submersible pump.

According to an aspect, the fluid may be a dielectric fluid.

According to an aspect, the electric submersible pump may comprise a fluid path having a fluid inlet connected to receive the fluid and a fluid outlet that discharges the fluid into the production path of the hydrocarbon well. The fluid outlet of the electric submersible pump may comprise an ESP check valve. The bypass check valve may close when the fluid pressure in the production path approaches the fluid pressure in the supply line.

According to an aspect, a pump check valve may be connected adjacent to the positive displacement pump in parallel with the bypass line.

According to an aspect, the valve may be a normally closed valve and closes when the positive displacement pump is off or power is lost to the system.

According to an aspect, there may be a control unit that controls the positive displacement pump, the electric submersible pump and the valve. The control unit may start the positive displacement pump and opens the valve immediately prior to starting the electric submersible pump.

According to an aspect, the supply line and one or more electric power delivery lines, control lines, and instrument lines may be installed within a coil tubing string connected to the electric submersible pump. The supply line may structurally support the one or more electric power delivery lines, control lines, and instrument lines.

According to another aspect, there is provided a method of delivering fluid to an inverted electric submersible pump, the electric submersible pump comprising a motor section positioned above a pump section in a production path of a hydrocarbon well, the method comprising the steps of:

- connecting a supply of fluid to the motor section of the electric submersible pump by a supply line, the supply line comprising a positive displacement pump, a bypass line in parallel with the positive displacement pump and a valve connected downstream of the positive displacement pump and the bypass line;
- starting the positive displacement pump such that the positive displacement pump pumps fluid from the supply of fluid to the motor section of the electric submersible pump;
- causing the valve to be opened when the positive displacement pump is on, the valve being closable when the positive displacement pump is off; and
- causing fluid to flow through the bypass line in response to a vacuum pressure in the supply line.

According to an aspect, the fluid may be a dielectric fluid.

According to an aspect, the hydrocarbon well may be an under-pressure well.

According to an aspect, the electric submersible pump may have a fluid path having a fluid inlet connected to receive the fluid and a fluid outlet that discharges the fluid into the production path of the hydrocarbon well. The fluid outlet of the electric submersible pump may comprise an ESP check valve.

According to an aspect, a pump check valve may be connected adjacent to the positive displacement pump and in parallel with the bypass line.

According to an aspect, the electric submersible pump may be turned on after the valve is opened or concurrently with the valve being opened. The bypass check valve may close when the fluid pressure in the production path approaches the fluid pressure in the supply line.

According to an aspect, the supply line and one or more electric power delivery lines, control lines, and instrument lines may be installed within a coil tubing string connected to the electric submersible pump. The supply line may structurally support the one or more electric power delivery lines, control lines, and instrument lines.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A method and system of supplying dielectric fluid to an electric submersible pump in a well with a positive well head pressure will now be described with reference to FIGS. 1 through 4.

The method and system described below may be used in connection with starting or stopping an electric submersible pump ("ESP") 10 that is being installed or removed without having to cool or depressurize the well. For example, the method and system may be particularly useful for starting or stopping an ESP 10 in thermally stimulated wells such as steam assisted gravity drainage ("SAGD") wells or other wells with a positive well head pressure, or other wells with a positive well head pressure that are required to be pressure relieved prior to being opened. Those skilled in the art may recognize other situations in which the method and system may also be used.

Figure 1:
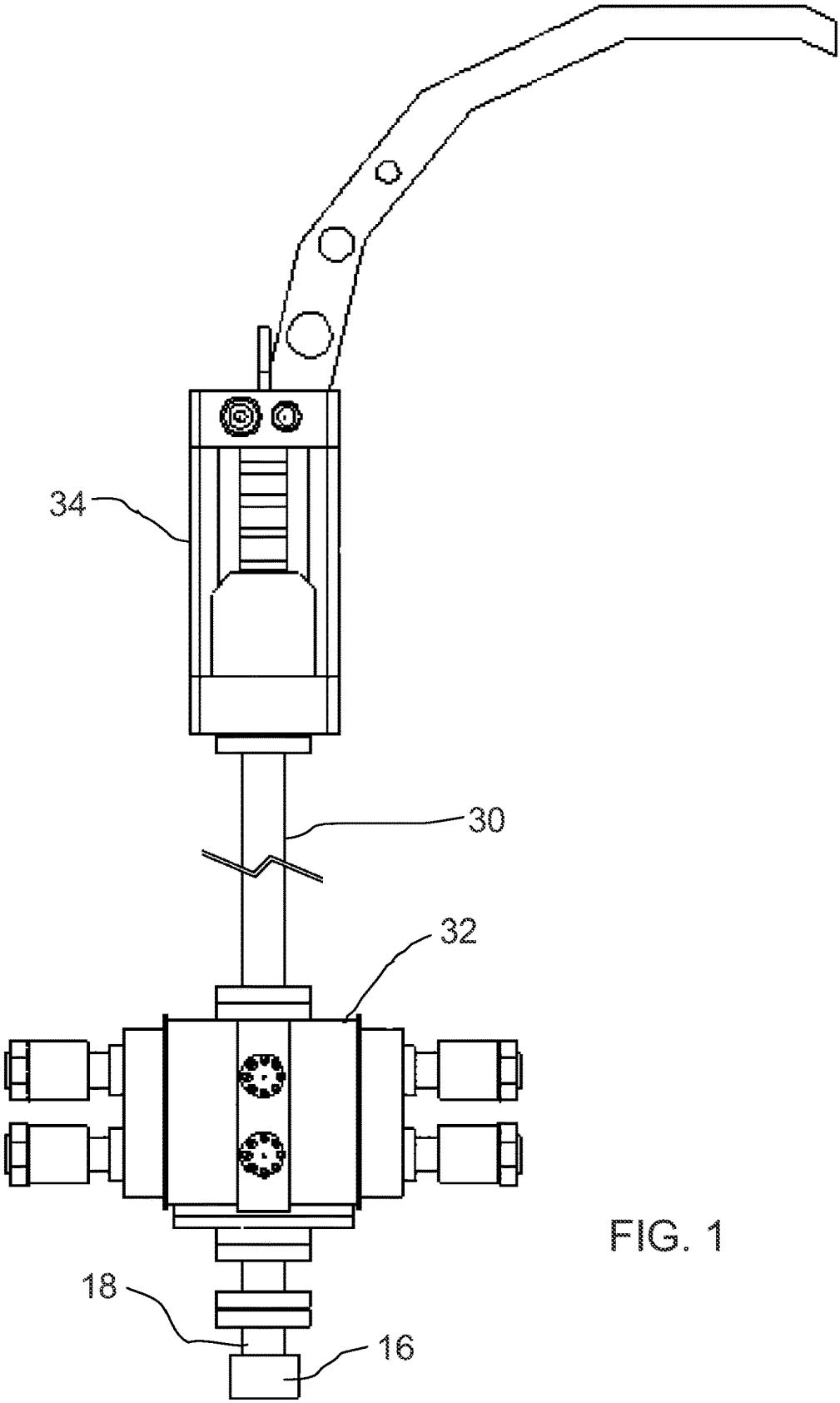
FIG. 1 is a side elevation view of an apparatus for servicing an electric submersible pump.
Figure 2:
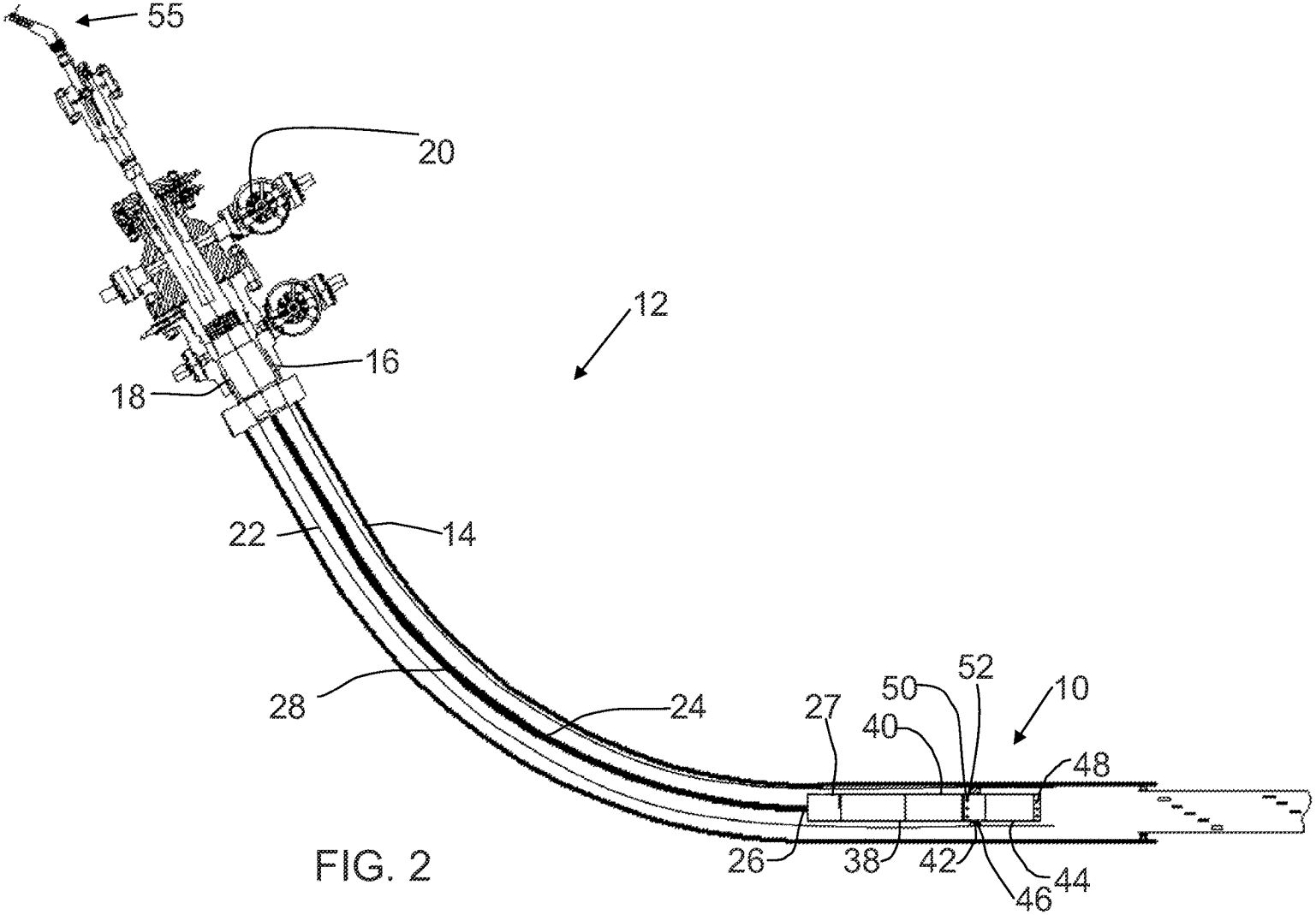
FIG. 2 is a side elevation view of a well completion with the electric submersible pump.
Figure 3:
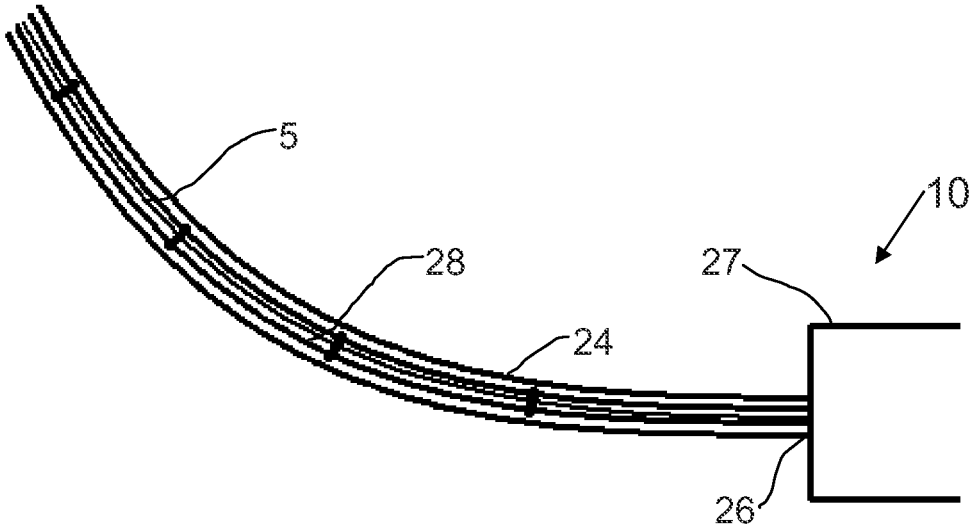
FIG. 3 is a detailed side elevation view of connection between the coiled tubing string and the electric submersible pump.
Figure 4:
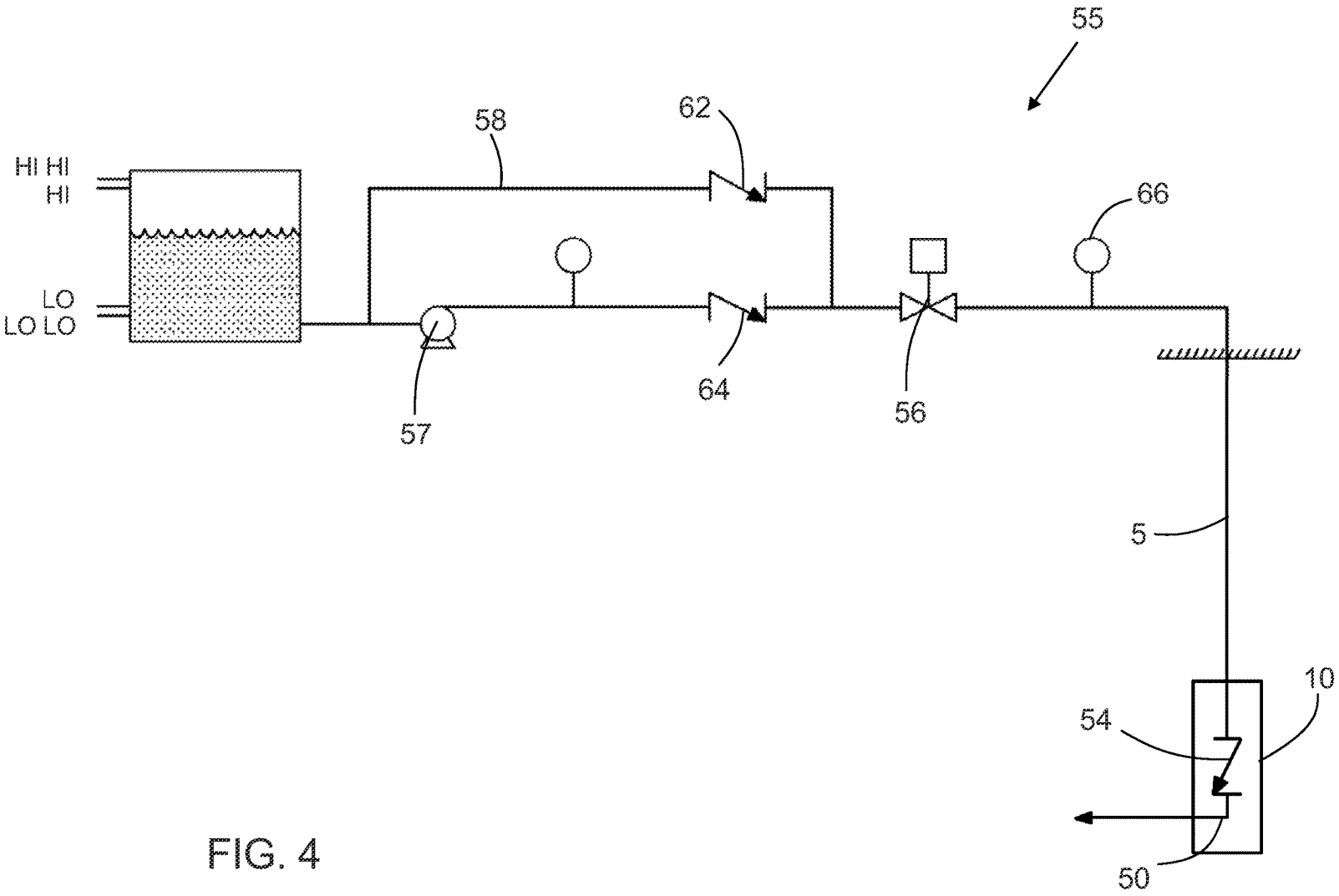
FIG. 4 is a schematic diagram of the dielectric fluid supply for the electric submersible pump.

There will now be described an example of a well that may benefit from the method described herein. It will be understood that this is done in order to give context to the method and system that will be described. However, it will be understood that modification may be made as the method and system may be used in other situations as well. Referring to FIG. 2, pressurized well 12 includes a casing 14 and a wellhead 16 mounted to casing 14. Wellhead 16 has a sealable injection port 18, and production ports 20. Referring to FIG. 1, injection port 18 may be sealed by a blowout preventer ("BOP") 32 as shown, or it may also be sealed by a valve, a plug, etc., which may be above or below the actual port 18. Referring again to FIG. 2, the number of production ports 20 may vary depending upon the design of wellhead 16. Production tubing 22 is positioned in casing 14 and is connected to wellhead 16. Production fluids that are pumped upward by ESP 10 flow through production tubing 22 and out production ports 20 of wellhead 16. ESP 10 is carried by a coil tubing string 24 at a downhole end 26 of coil tubing string 24, and is sized such that it is able to be run through production tubing 22. Supply lines 28, which may be instrumentation lines, control lines, or electrical or fluid delivery lines, are preferably all run through and enclosed within coil tubing string 24 and connect ESP 10. Supply lines 28 may include power, communication lines for providing control signals, and oil feed lines that continuously provide clean oil to the ESP 10 and maintain a positive pressure relative to the well pressure at the ESP 10 location. Preferably, fluids provided through supply lines 28 will be fed using a positive displacement pump 57 at ground surface (FIG. 4). Also preferably, ESP 10 is designed such that clean oil is constantly pumped through from surface, which prevents any unnecessary wear from dirty oil, and also helps create a positive seal against downhole contaminants. This may be done through a capillary tube, such as a metal capillary tube that can provide structural support to other supply lines 28, such as power or signal lines. A pump-receiving housing 30, shown in FIG. 1, is located above injection port 18 of wellhead 16. The height of pump-receiving housing 30 will depend upon the size of ESP 10. Pump-receiving housing 30 is designed such that it may be sealed to the atmosphere when injection port 18 is open, and openable to the atmosphere when injection port 18 is sealed. In other words, housing 30 works with injection port 18 to ensure that well 12 is always sealed when it is pressurized. Referring to FIG. 1, a BOP 32 is located above wellhead 16 and below pump-receiving housing 30. A coil tubing injector 34 is located above pump-receiving housing 30 and, referring to FIG. 2, is used to control the position of coil tubing string 24 and ESP 10 in well 12.

With the elements described above, ESP 10 may be installed or removed without having to cool well 12. In order to insert ESP 10 into a well with a positive well head pressure, the ESP 10 is installed in the pump-receiving housing 30, preferably at the electric submersible pump assembly facility. The pump-receiving housing 30, which houses ESP 10, can then be transported to the well site. Referring to FIG. 1, BOP 32 is installed above injection port 18 and sealed. Coil tubing string 24 is connected to ESP 10. Pump-receiving housing 30, which houses ESP 10 is installed above BOP 32, is sealed to atmosphere, and opened to BOP 32. ESP 10, which is connected to coil tubing string 24, is inserted through injection port 18 in wellhead 16 and into well 12 by operating coil tubing injector 34. In order to remove ESP 10 from pressurized well 12, the process is reversed, with coil tubing injector 34 lifting ESP 10 through wellhead 16 and into housing 30. BOP 32 is then closed and sealed, and housing 30 is opened to provide access to ESP 10. ESP 10 may then be serviced or replaced, as necessary.

As depicted, ESP 10 is preferably an inverted electric submersible pump, and is run off a 1¼"-3½" coil tubing string 24 that contains the instrumentation lines, control lines, power or fluid delivery lines. Other sizes may also be used, depending on the preferences of the user and the requirements of the well. When compared with traditional electric submersible pumps, ESP 10 lacks the seal section, motor pothead and wellhead feedthrough. As shown in FIG. 2, ESP 10 includes a power head 27, motor section 38, thrust chamber 40, electric submersible pressure sealing seat 42 and electric submersible pump section 44. Pressure sealing seat 42, commonly referred to in industry as a pump seating nipple, has a seal 46 between inlet ports 48 and outlet ports 50. Inlet ports 48 are in communication with downhole fluids to be pumped to surface via outlet ports 50, which are positioned within production tubing 22.

Fluid is supplied to ESP 10 by supply line 5 (FIG. 3), flows through ESP 10 along a flow path (not shown), and exits through a fluid outlet 52 in ESP 10 into well 12. In one example, thrust chamber 40 has two mechanical seals (not shown) with a check valve 54 (FIG. 4). This replaces the conventional seal/protector section that separates pump section 44 and motor section 38. Check valve 54 allows the fluid supplied by supply line 5 to exit thrust chamber 40 and comingle with, for example, produced fluids from the well with the pump discharge from outlet ports 50. The flow path may take any form necessary for the fluid to be properly used by ESP 10.

The fluid being supplied is preferably a dielectric material that may be used as a dielectric barrier to protect ESP 10 from shorting out due to water that may otherwise enter ESP 10. The fluid may also be used to lubricate and cool ESP 10. An example of a suitable fluid may include clean ESP #7 motor oil. It may be necessary to heat supply line 5 or other lines in order to keep oil from becoming too viscous and allow the pressure to be maintained.

Referring to FIGS. 2 and 4, the fluid delivery system has a surface mounted pumping and control unit 55 that maintains a constant flow of oil through the stainless steel capillary tubing 5 of FIG. 4 and into ESP 10, regardless of the pump discharge pressure. In this way, the internal pressure of the capillary tubing 5 of FIG. 4 and the motor 27 and thrust chamber 40 of FIG. 2 is maintained at a pressure that is 10 psi to 50 psi higher than the bottom hole pressure at the pump discharge. This pressure difference may be greater or less than 10 psi to 50 psi. This will ensure that no bottom hole fluids shall enter and contaminate the motor 27 or thrust chamber 40.

Pumping and control unit 55 has a positive displacement pump 57 that pumps fluid through supply line 5 at a constant rate, regardless of the pressure. Pumping and control unit 55 also has a valve 56 connected between positive displacement pump 57 and ESP 10. Valve 56 is designed to be opened when ESP 10 is on and closed otherwise. Valve 56 may be a normally closed solenoid valve that opens in response to ESP 10 being activated. An example of how this may be implemented will be described below. There is also a bypass line 58 that is connected in parallel to positive displacement pump 57 between valve 56 and a supply of fluid 60. As shown, bypass line 58 and positive displacement pump 57 are provided with check valves 62 and 64. Check valve 62 permits the flow of fluid from supply of fluid to the electric submersible pump, while check valve 64 adjacent to positive displacement pump 57 is primarily provided as a safety feature.

An example of a start-up procedure for ESP 10 that uses the present method and system will now be described.

Prior to start-up, the ESP pump discharge will be at reservoir pressure. Since the typical SAGD well is under-pressured, the reservoir pressure will be lower than the hydrostatic head of the fluid in line 5. At this time, valve 56 should be closed and ESP 10 is off. The fluid in supply line 5 downstream of valve 56 will bleed through the downhole check valve, such as check valve 54 at outlet 50 of ESP 10 and into the reservoir until the static pressure head in supply line 5 is balanced with the reservoir pressure plus the cracking pressure of check valve 54. This will create a region near the top of supply line 5 that is under vacuum pressure, which will be filled with a foamy mixture of oil and oil vapours. The magnitude of the vacuum is measured by the pressure sensor 66, such as a pressure indicating transmitter (PIT) that is positioned downstream of valve 56.

When it comes time to start ESP 10, the operator sends a signal to pumping and control unit 55, such as by pressing the start button. Control unit 55 opens valve 56 and starts positive displacement pump 57. Because positive displacement pump 57 is only capable of supplying oil at a specified rate regardless of pressure, it is generally not able to supply a sufficient flow of oil to satisfy the vacuum in supply line 5 when valve 56 opens. As such, the vacuum pressure causes check valve 62 to open and fluid is permitted to flow rapidly through bypass line 58. As oil flows in, oil continues to bleed out the down hole check valve 54, thus maintaining the pressure balance with the reservoir. As ESP 10 starts up, it begins to generate higher and higher discharge pressure in production tubing 22. As the pressure continues to build, fluid continues to flow at a high rate through bypass line 58 and out check valve 54 to maintain the required positive pressure. Once the discharge pressure from ESP 10 reaches equilibrium with the hydrostatic pressure of the fluid in supply line 5, supply line 5 will then be completely filled with liquid phase oil and there is no longer a vacuum present. At this point, check valve 62 on bypass line 58 will close and positive displacement pump 57 will continue to supply oil through supply line 5.

The discharge pressure of ESP 10 will increase towards its full operating pressure (the pressure required to lift produced fluids to surface while overcoming all sources of back pressure). The positive displacement pump continues to flow at the specified slow flow rate and adds oil as necessary to maintain the positive pressure in the system. The pressure within ESP 10 and supply line 5 will generally be the reservoir pressure plus any friction losses in supply line 5 plus the cracking pressure of check valve 54. Preferably, the pressure in ESP 10 is about 10 to 50 psi greater than the pump discharge pressure caused by the operation of ESP 10, but may be greater or less than 10 to 50 psi.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of delivering fluid to an inverted electric submersible pump, the electric submersible pump comprising a motor section positioned above a pump section in a production path of a hydrocarbon well, the method comprising the steps of:

connecting a supply of fluid to the motor section of the electric submersible pump by a supply line, the supply of fluid further comprising:

a positive displacement pump connected to the supply line;

a bypass line in parallel with the positive displacement pump; and a valve connected to the supply line downstream of the positive displacement pump and the bypass line;

starting the positive displacement pump such that the positive displacement pump pumps fluid from the supply of fluid through the supply line to the motor section of the electric submersible pump;

causing the valve to be opened when the positive displacement pump is on, the valve being closable when the positive displacement pump is off; and causing fluid to flow through the bypass line in response to a vacuum pressure in the supply line.

2. The method of claim 1, wherein the fluid is a dielectric fluid.

3. The method of claim 1, wherein the hydrocarbon well is an under-pressure well.

4. The method of claim 1, wherein the fluid flows through a fluid path through the electric submersible pump and is discharged from the fluid path into the production path of the hydrocarbon well.

5. The method of claim 4, wherein the fluid outlet of the fluid path through the electric submersible pump comprises an electric submersible pump check valve.

6. The method of claim 1, further comprising a pump check valve connected adjacent to the positive displacement pump and in parallel with the bypass line.

7. The method of claim 1, wherein the electric submersible pump is turned on after the valve is opened or concurrently with the valve being opened.

8. The method of claim 1, wherein the bypass line comprises a bypass check valve that causes fluid to flow in response to the vacuum pressure in the supply line, the bypass check valve closing when the fluid pressure in the production path approaches the fluid pressure in the supply line.

9. The method of claim 1, wherein the supply line and one or more electric power delivery lines, control lines, and instrument lines are installed within a coil tubing string connected to the electric submersible pump.

10. The method of claim 9, wherein the supply line structurally supports the one or more electric power delivery lines, control lines, and instrument lines.

* * * * *